US008695157B2

(12) United States Patent
Beskow et al.

(10) Patent No.: US 8,695,157 B2
(45) Date of Patent: Apr. 15, 2014

(54) VACUUM CLEANER WITH FILTER CLEANING

(75) Inventors: Jonas Beskow, Stockholm (SE); Håkan Miefalk, Järfälla (SE); Stefan Jonsson, Stockholm (SE); Anders Haegermarck, Trångsund (SE)

(73) Assignee: AB Electrolux (SE)

( * ) Notice: Subject to any disclaimer, the term of this patent is extended or adjusted under 35 U.S.C. 154(b) by 346 days.

(21) Appl. No.: 12/676,792

(22) PCT Filed: Aug. 28, 2008

(86) PCT No.: PCT/SE2008/000479

§ 371 (c)(1),
(2), (4) Date: Aug. 9, 2010

(87) PCT Pub. No.: WO2009/031961

PCT Pub. Date: Mar. 12, 2009

(65) Prior Publication Data

US 2010/0293743 A1 Nov. 25, 2010

Related U.S. Application Data

(60) Provisional application No. 60/970,712, filed on Sep. 7, 2007.

(30) Foreign Application Priority Data

Sep. 7, 2007 (SE) ..... 0702005

(51) Int. Cl.
*A47L 9/10* (2006.01)

(52) U.S. Cl.
USPC ..... 15/352

(58) Field of Classification Search
USPC ..... 15/352, 347
See application file for complete search history.

(56) References Cited

U.S. PATENT DOCUMENTS

| | | | | |
|---|---|---|---|---|
| 4,719,662 | A * | 1/1988 | Horak et al. | 15/301 |
| 6,601,265 | B1 * | 8/2003 | Burlington | 15/319 |
| 6,681,412 | B2 * | 1/2004 | Doss et al. | 4/431 |
| 2007/0125049 | A1 * | 6/2007 | Menrik et al. | 55/337 |
| 2010/0146720 | A1 * | 6/2010 | Fillon | 15/3.5 |
| 2012/0080057 | A1 * | 4/2012 | Jonsson et al. | 134/21 |

FOREIGN PATENT DOCUMENTS

| | | |
|---|---|---|
| CN | 1889879 | 1/2007 |
| WO | WO 85/02528 | 6/1985 |
| WO | WO 90/12532 | 11/1990 |
| WO | WO 2004/100752 | 11/2004 |
| WO | WO 2005/053497 | 6/2005 |

* cited by examiner

*Primary Examiner* — Lee D Wilson
*Assistant Examiner* — Henry Hong
(74) *Attorney, Agent, or Firm* — RatnerPrestia

(57) ABSTRACT

A vacuum cleaner with a vacuum, a filtering unit, a switching device for switching between a vacuum cleaning and filter cleaning modes, and a separating unit is disclosed. In the vacuum cleaning mode, the vacuum forces a first air stream in a first air stream path through the filtering unit, in a first direction, to filter out dust from the dust laden air stream. In the filter cleaning mode, the vacuum forces a second air stream in a second air stream path through the filtering unit, in a second direction reverse to the first direction, to remove dust from the filtering unit. In the filter cleaning mode, the separating unit is in the air path between the vacuum and the filtering unit to separate dust removed from the filtering unit. In the vacuum cleaning mode, the separating unit is not in an air stream path.

18 Claims, 3 Drawing Sheets

VACUUM CLEANER WITH FILTER CLEANING

This application claims priority to international application no. PCT/SE2008/000479, filed on Aug. 28, 2008, and Swedish application no. SE0702005-0, filed on Sep. 7, 2007, and claims the benefit of U.S. provisional application No. 60/970,712.

TECHNICAL FIELD

The present invention relates to a vacuum cleaner configured to operate in a vacuum cleaning mode and a filter cleaning mode, comprising a vacuum source for creating an air flow, a filtering unit for filtering a dust laden air stream, switching means for switching the vacuum cleaner between a vacuum cleaning mode and a filter cleaning mode, and a separating unit for separating dust from a dust laden air stream.

TECHNICAL BACKGROUND

A vacuum cleaner arranged to operate in a vacuum cleaning mode and a filter cleaning mode is disclosed in WO 2005/053497 A1. The vacuum cleaner comprises a separating unit for separating dust particles from an air flow. The dust particles not separated from the airflow is collected by a downstream filter. In this document, two filters are used, and when one is clogged by fine dust, the user is allowed to let the filters switch places and to clean the clogged filter using the separating unit and the other downstream filter. Both filters are located downstream, as seen in the air stream path, in relation to the separating unit.

SUMMARY

An object of the present disclosure is to provide a novel vacuum cleaner arranged to operate in a vacuum cleaning mode and a filter cleaning mode.

This and other objects may be achieved by a vacuum cleaner as defined in claim 1. Variations thereof are defined in the dependent claims.

According to an aspect of the invention there is provided a vacuum cleaner configured to operate in a vacuum cleaning mode and a filter cleaning mode. The vacuum cleaner has a vacuum source for creating an air flow through the vacuum cleaner, a filtering unit for filtering a dust laden air stream, switching means for switching the vacuum cleaner between the vacuum cleaning and the filter cleaning mode, and a separating unit for separating dust from a dust laden air stream. In the vacuum cleaning mode, the vacuum source is arranged to force an air stream in a first air stream path through the filtering unit, in a first direction in order to filter out dust from the dust laden air stream, and to the vacuum source. Furthermore, in the filter cleaning mode, the vacuum source is arranged to force an air stream in a second air stream path through the filtering unit, in a second direction reverse to the first direction in order to remove dust from the filtering unit, and to the vacuum source. The separating unit is, in the filter cleaning mode, connected in the second air stream path between the vacuum source and the filtering unit to separate dust removed from the filtering unit from the air stream. In the vacuum cleaning mode, the separating unit is operatively disconnected from the first air stream path.

Thus, the present disclosure is based on the advantageous idea of providing a vacuum cleaner with a filter or filtering unit used for filtering out dust during vacuum cleaning, and a separator or separating unit for collecting dust from the vacuum cleaning filters in a filter cleaning process. This entails a number of advantages in comparison to the vacuum cleaners having separators, often cyclone separators, for collecting dust during the vacuum cleaning process.

For instance, a reduction in pressure differential during vacuum cleaning may be obtained, which results in a reduction of energy consumption, as well as a noise reduction during vacuum cleaning.

A more compact design may be possible, since a filter and a separator optimized for filter cleaning may be provided with much smaller dimensions than a separator used for vacuum cleaning.

Moreover, with the separating unit operatively disconnected in the vacuum cleaning mode, a high separation efficiency may be obtained without suffering from the drawback of a high flow resistance. In other words, there need not be any trade-off between flow performance and separation performance, as in the case in vacuum cleaners where a separation unit is operatively connected during vacuum cleaning. Thus, according to the present invention, a vacuum cleaner with both a low flow resistance and a high separation efficiency may be obtained.

Furthermore, there is no need for the user to move filters when a filter needs cleaning. Thereby, the filter cleaning process becomes easier for the user, in terms of understanding, as well as carrying out the filter cleaning process.

There is no need for auxiliary separators since the separating unit is only operatively connected in the air stream path during filter cleaning. During vacuum cleaning, the separating unit remains essentially passive.

In the vacuum cleaning mode, the separating unit is operatively disconnected from the air stream produced during vacuum cleaning. This can be achieved in different ways, for instance by altogether disconnecting the separating unit. In another example, the channel or path to the separating unit is kept open, but a further air path having lower flow resistance than the air path through the separating unit is provided such that the flow of air in effect will bypass the separating unit.

Even though one separator could be sufficient for achieving the desired filter cleaning, the separating unit may comprise one separator or a plurality of separators, for instance two to four separators.

Likewise, the filtering unit may be comprised of one filter or a plurality of filters arranged in series or in parallel. Furthermore, the filtering unit may comprise a filter for collecting fine dust, as well as larger dust or debris particles. The term filter is not restricted to any particular type of filter. On the contrary, any suitable filter for filtering out dust and particles from a dust laden air stream is contemplated for the present invention. Examples include, but are not restricted to, HEPA and other micropore filters, rigid, semi-rigid and flexible filters, mesh filters, perforated plate filters, filters made of metal, paper, fabric, or plastic, and combinations thereof. Furthermore, the filtering unit may comprise a combination of different or similar filters, arranged in series or parallel.

Preferably, the separating unit comprises one or more cyclone separators. However, other types of separators are also conceivable. If a cyclone separator is used in said filtering unit, the dimensions thereof are preferably optimized for filter cleaning. Then, the size of the vortex chamber is preferably considerably smaller than the size of the vortex chamber in a cyclone separator used for vacuum cleaning, resulting in a higher flow resistance that would be well suited for filter cleaning, but unsuited for vacuum cleaning.

The vacuum cleaner may be a stationary type vacuum cleaner, such as a central vacuum cleaner, or a movable vacuum cleaner, such as of the canister type, the upright type, the stick type, a robotic or a handheld vacuum cleaner.

The vacuum cleaner may further comprise means for rapping or vibrating the filter/s in the filter cleaning mode.

The vacuum cleaner may be arranged to enter the filter cleaning mode automatically, or at least without effort from the user. For instance, in some embodiments, a control means may be arranged to initiate a filter cleaning process when a vacuum cleaning operation is to commence and the user turns on the vacuum cleaner. In other embodiments, the control means can be arranged to initiate a filter cleaning each time the filter has been emptied of large debris collected during vacuum cleaning. In yet other embodiments, the user may trigger a filter cleaning by the push of a button. Optionally, an indicator, audible or visible, could be used for alerting the user to the fact that the filter needs to be cleaned. In yet further embodiments, the control means can be arranged to initiate a filter cleaning upon completion of a vacuum cleaning operation, i.e. when the user turns off the vacuum cleaner.

As understood by the skilled person, these alternatives could also be combined. For instance, the user could empty the filter from large debris following or preceding a vacuum cleaning operation. Then, when the vacuum cleaner is turned on, the control means initiates the filter cleaning. An emptying of the filtering unit from large debris could improve and possibly speed up a subsequent filter cleaning process.

It will be understood that the foregoing summary is exemplary, and not intended to limit the scope of the invention as claimed.

DETAILED DESCRIPTION OF EMBODIMENTS

The present invention is relevant for vacuum cleaners of stationary and movable types, including both canister and cylinder type vacuum cleaners. Thus, the invention is also relevant for central, stick, handheld, or robotic vacuum cleaners, etc.

Figure 1:
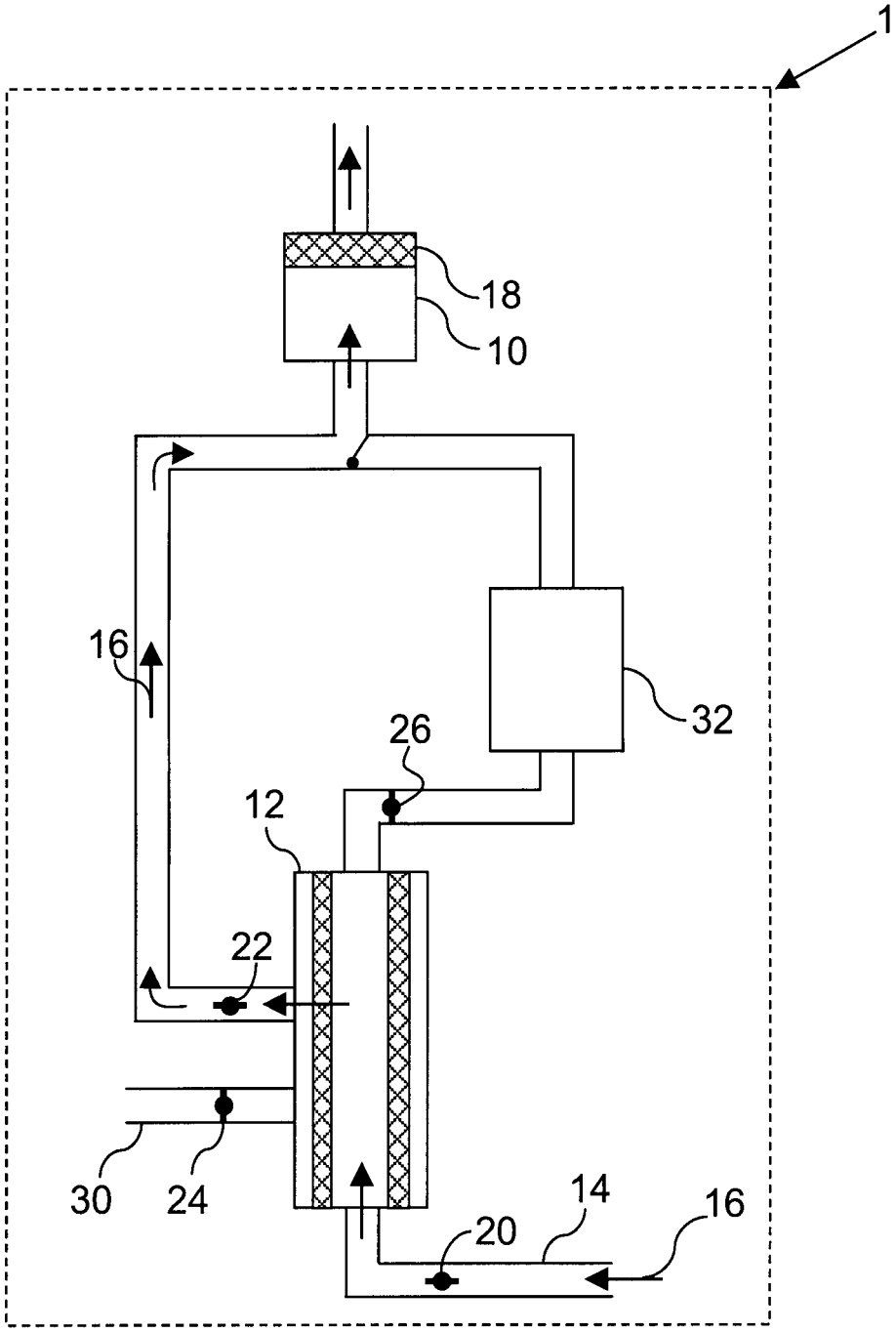
FIG. 1 schematically illustrates a vacuum cleaner operating in a vacuum cleaning mode.
Figure 2:
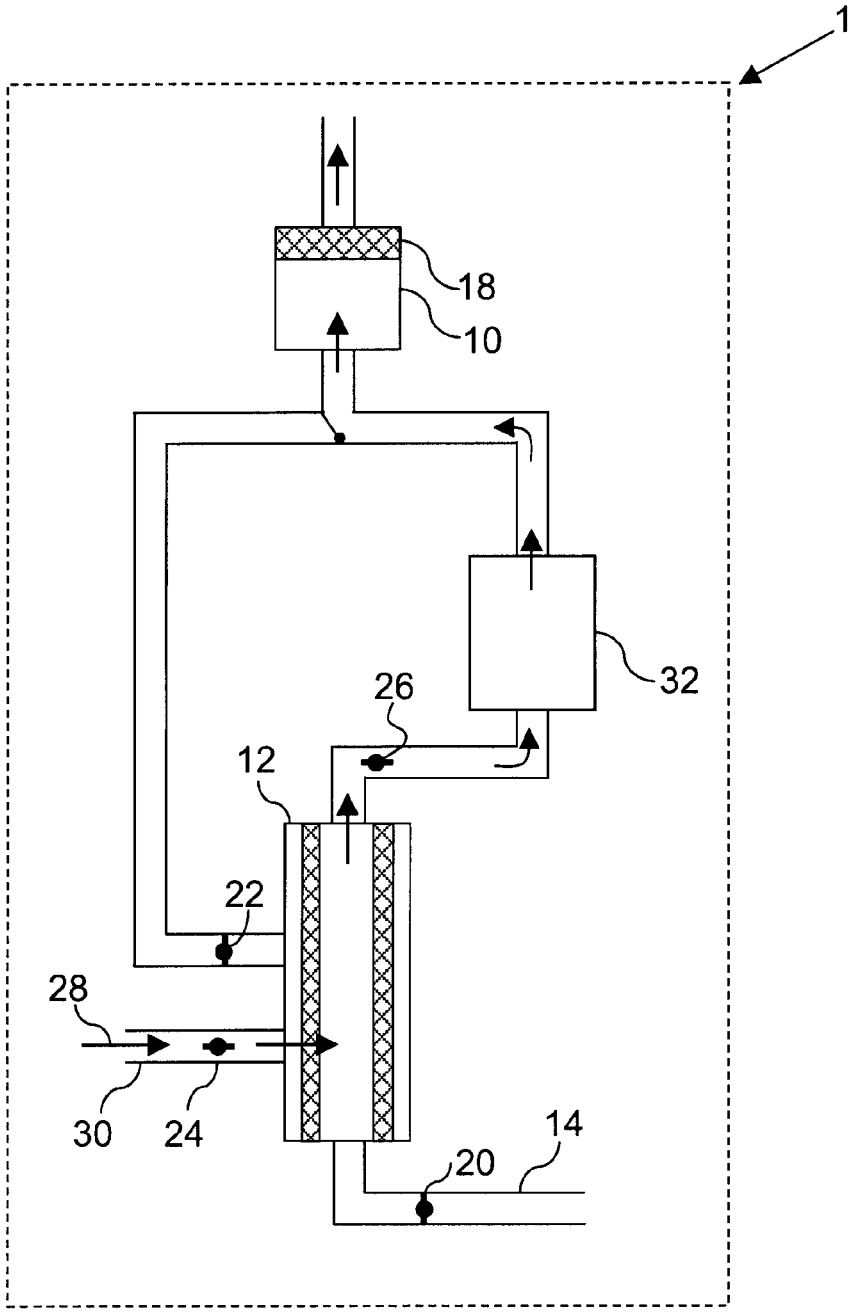
FIG. 2 schematically illustrates a vacuum cleaner operating in a filter cleaning mode.

FIG. 1 illustrates a vacuum cleaner 1 operating in a vacuum cleaning mode, while FIG. 2 illustrates the vacuum cleaner 1 when switched to a filter cleaning mode. The switching of the vacuum cleaner 1 from the vacuum cleaning mode to the filter cleaning mode may be done manually or automatically.

With reference to both FIG. 1 and FIG. 2, the vacuum cleaner 1 has a vacuum source 10, typically comprising a fan driven by an electric motor. The vacuum source 10 produces an air flow which makes the vacuum cleaner 1 capable of collecting dust from floors and carpets, etc. The vacuum source 10 is, via a filtering unit 12, connected to an inlet 14 for a dust laden air stream 16.

As shown in FIG. 1, the filtering unit 12 filters out the dust from the dust laden air stream 16. The air stream 16 then passes through the vacuum source 10, and is finally filtered by a motor filter 18 to collect e.g. carbon particles released by the vacuum source 10. The air stream path of FIG. 1 is accomplished by keeping a first set of valves 20, 22 open, while a second set of valves 24, 26 are closed.

In FIG. 2, the vacuum cleaner 1 has been switched to a filter cleaning mode. In the filter cleaning mode, the filtering unit 12 is cleaned such that its flow resistance may be reduced by removing dust that may otherwise clog the filter. The vacuum cleaner 1 is switched to the filter cleaning mode by closing the first set of valves 20, 22 and opening the second set of valves 24, 26. Then, an ambient air stream 28 is drawn through a filter cleaning opening 30 and passes through the filtering unit 12 in a direction reverse to that of the vacuum cleaning mode, such that the filtering unit 12 may release dust into the air stream 28. This process may optionally be enhanced by means of a rapper or vibrator providing a rapping or vibration of the filter in the filtering unit.

Note that the layout illustrated in FIGS. 1 and 2 is only a schematic example. Other layouts are possible within the scope of the present invention and the functions provided by the valve arrangement may be achieved differently.

When the air stream 28 has passed the filtering unit 12, it then passes through a separating unit 32, such that dust released from the filtering unit 12 is separated from the air stream 28. The air stream 28 then passes through the vacuum source 10 and the motor filter 18.

This process cleans the filtering unit 12, such that the time between replacements may be significantly extended. The separation ratio for a given dust (e.g. a standard dust) will be much higher than in the vacuum cleaning mode. The higher separation ratio comes at the cost of a higher flow resistance, but in the filter cleaning mode this may be allowed, as there is no need to collect dust comprising heavier particles, such as when vacuum cleaning a floor or a carpet. This higher separation ratio makes it possible to efficiently separate the fine dust fractions released from the filtering unit 12.

The filtering unit 12 in this configuration may be cleaned regularly, the filter cleaning mode being entered either manually or automatically, e.g. when the user begins or finishes a vacuum cleaning. It is also possible to provide a pressure sensor that measures the pressure drop over the filtering unit 12 in order to determine when filter cleaning is needed. The filtering unit may further comprise a plurality of filters.

Thanks to the regular cleaning of the filtering unit, the filtering unit 12 need not be able to carry a lot of dust. Micro pore filters such as filters made of expanded PTFE (polytetrafluoroethylene), e.g. GORE-TEX (trademark) may be considered. On such filters, the dust is collected on top of the filter surface, rather than in the depth of the filter as in a conventional filter. A micro pore filter may therefore be easily cleaned.

Figure 3:
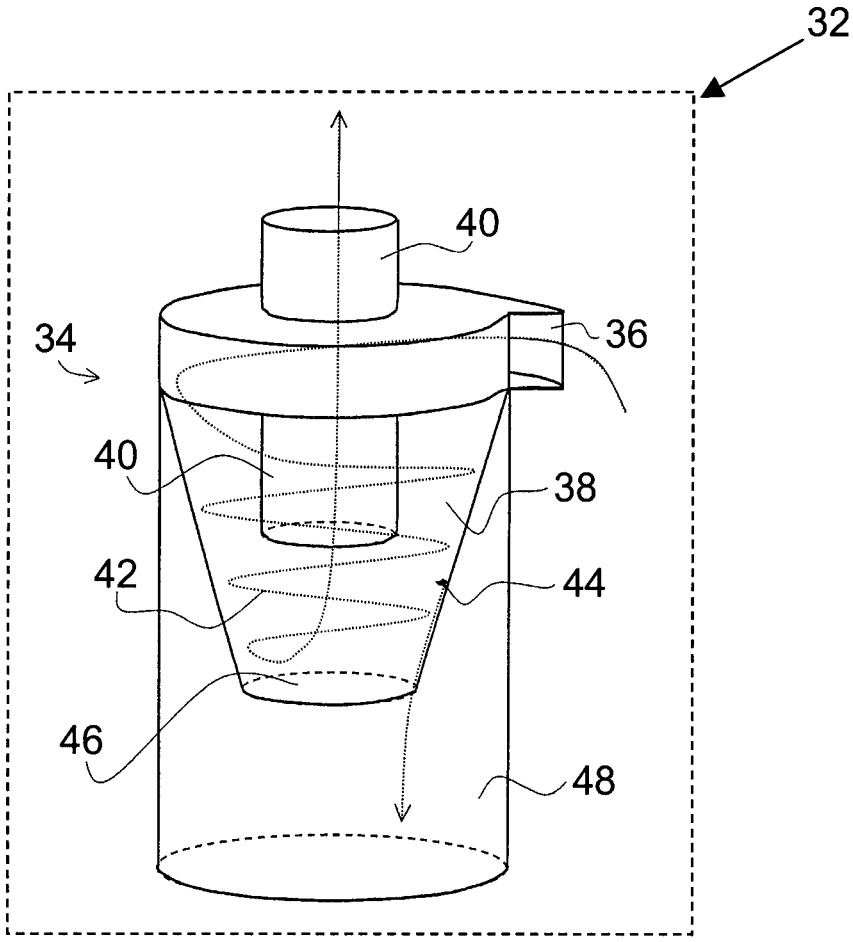
FIG. 3 schematically illustrates a cyclone separator.

The separating unit 32 may comprise at least one cyclone separator 34, which is illustrated schematically in FIG. 3. The cyclone separator 34 has an inlet slot 36, through which dust laden air enters into a vortex chamber 38, which may have a substantially circular cross section perpendicularly to the vertical direction, as illustrated in FIG. 3. The dust laden air enters along a tangential direction at the periphery of the vortex chamber 38, and is sucked out of the vortex chamber 38 via an outlet tube 40, which is inserted in the centre of the vortex chamber 38. This makes the dust laden air flow in a vortex 42 through the vortex chamber 38.

Dust particles 44 are therefore subjected to a centrifugal force depending on $v^2/R$, where v is the flow velocity and R is the diameter of the vortex chamber cross section, which forces the particles towards the vortex chamber side wall. Once a dust particle 44 reaches the wall, it is caught in a secondary air stream directed downwards in the figure, and falls through an opening 46 in the bottom part of the vortex chamber 38 and into a dust chamber 48.

The dust chamber 48 may be conveniently emptied by the user of the vacuum cleaner, and the use of a cyclone separator of this kind may obviate the need for conventional vacuum cleaner filter bags.

In the illustrated cyclone separator 34, the vortex chamber 38 has a cross-section which tapers in the downward direction and has a minimum cross section at the opening. More particularly, the vortex chamber has a frustoconical shape. However, it should be noted that other tapering forms as well as cylindrical, non-tapering forms may be considered in a cyclone separator.

Often, a cyclone separator or a separating unit of another type will have a trade-off between separation efficiency and flow resistance: the higher the efficiency the higher the resistance. Therefore, e.g. if a cyclone separator capable of providing a very high separation efficiency/ratio for a standard dust would be used, the flow resistance would be too high to provide an acceptable airflow of a vacuum cleaner with a regular vacuum source and the vacuum cleaner would not be capable of picking up dust from a floor or a carpet in an acceptable manner. The vacuum cleaner 1 according to the present invention is provided with a separating unit 32 that is only in use in the filter cleaning mode, and that is operatively disconnected in the vacuum cleaning mode.

Therefore, the vacuum cleaner 1 of the present invention can be optimised for vacuum cleaning in the vacuum cleaning mode and for dust separation in the filter cleaning mode, and does not have said trade-off.

In summary, the present invention relates to a vacuum cleaner 1 comprising a filtering unit 12, a vacuum source 10 for creating a negative air pressure, and separating unit 32. The vacuum cleaner 1 is configured to operate in a vacuum cleaning mode, and is switchable to a filter cleaning mode, wherein the vacuum source 10 is connected to the separating unit 32 to force an air stream in a reverse direction through the filtering unit in order to remove dust therefrom, and the separating unit 32 is arranged to separate and collect dust, released by the filtering unit 12, from the air stream.

The invention is not restricted to the described embodiments, and may be varied and altered within the scope of the appended claims.

We claim:

1. A vacuum cleaner configured to operate in a vacuum cleaning mode and a filter cleaning mode, the vacuum cleaner comprising;

a vacuum source;

a filtering unit for filtering a dust laden air stream, the filtering unit comprising:

at least one filter having opposite first and second sides, a filtering unit outlet passage selectively fluidly connecting the second side of the at least one filter to the vacuum source, and a filter cleaning inlet passage selectively fluidly connecting the second side of the at least one filter to a source of ambient air separate from the vacuum source;

switching means for switching the vacuum cleaner between the vacuum cleaning mode and the filter cleaning mode; and a separating unit for separating dust from a dust laden air stream;

wherein:

in the vacuum cleaning mode, the vacuum source is arranged to force a first air stream in a first air stream path through the at least one filter in a first direction from the first side of the at least filter to the second side of the at least one filter to filter out dust from the dust laden air stream, and to the vacuum source, and in the filter cleaning mode, the vacuum source is arranged to force a second air stream in a second air stream path from the filter cleaning inlet passage, through the at least one filter in a second direction from the second side of the at least one filter to the first side of the at least one filter to remove dust from the filtering unit, and to the vacuum source; and wherein the separating unit is, in the filter cleaning mode, connected in the second air stream path between the vacuum source and the filtering unit to separate dust removed from the filtering unit, and, in the vacuum cleaning mode, the separating unit is operatively disconnected from the first air stream path so that dust from the filtering unit only enters the separating unit during the filter cleaning mode.

2. A vacuum cleaner according to claim 1, wherein the separating unit comprises at least one cyclone separator.

3. A vacuum cleaner according to claim 2, wherein the separating unit comprises two or more cyclone separators.

4. A vacuum cleaner according to claim 1, wherein the filtering unit comprises a plurality of filters.

5. A vacuum cleaner according to claim 1, wherein the filtering unit comprises a micro pore filter.

6. A vacuum cleaner according to claim 1, wherein the switching means comprises a valve arrangement for directing the first air stream and the second air stream.

7. A vacuum cleaner according to claim 1, wherein the switching means is arranged to be controlled by the user.

8. A vacuum cleaner according to claim 1, further comprising control means for controlling and activating the switching means.

9. A vacuum cleaner according to claim 8, wherein the control means are arranged to automatically switch the vacuum cleaner into the filter cleaning mode at the start of a vacuum cleaning procedure before entering the vacuum cleaning mode, or arranged to automatically switch the vacuum cleaner into the filter cleaning mode at the end of a vacuum cleaning procedure after leaving the vacuum cleaning mode.

10. A vacuum cleaner configured to operate in a vacuum cleaning mode and a filter cleaning mode, the vacuum cleaner comprising;

a vacuum source;

a filtering unit for filtering a dust laden air stream, the filtering unit comprising:

at least one filter having opposite first and second sides, a filtering unit outlet passage selectively fluidly connecting the second side of the at least one filter to the vacuum source, and a filter cleaning inlet passage selectively fluidly connecting the second side of the at least one filter to a source of ambient air separate from the vacuum source;

a plurality of valves for switching the vacuum cleaner between the vacuum cleaning mode and the filter cleaning mode; and a separating unit for separating dust from a dust laden air stream;

wherein:

in the vacuum cleaning mode, the vacuum source is arranged to force a first air stream in a first air stream path through the at least one filter in a first direction from the first side of the at least filter to the second side of the at least one filter to filter out dust from the dust laden air stream, and to the vacuum source, and in the filter cleaning mode, the vacuum source is arranged to force a second air stream in a second air stream path from the filter cleaning inlet passage, through the at least one filter in a second direction from the second side of the at least one filter to the first side of the at least one filter to remove dust from the filtering unit, and to the vacuum source; and wherein the separating unit is, in the filter cleaning mode, connected in the second air stream path between the vacuum source and the filtering unit to separate dust removed from the filtering unit, and, in the vacuum cleaning mode, the separating unit is operatively disconnected from the first air stream path so that dust from the filtering unit only enters the separating unit during the filter cleaning mode.

11. A vacuum cleaner according to claim 10, wherein the separating unit comprises one or more cyclone separators.

12. A vacuum cleaner according to claim 10, wherein the filtering unit comprises a plurality of filters.

13. A vacuum cleaner configured to operate in a vacuum cleaning mode and a filter cleaning mode, the vacuum cleaner comprising:

a filtering unit having:

at least one filter having opposite first and second sides, a first filtering unit inlet located on the first side of the at least one filter, a first filtering unit outlet located on the second side of the at least one filter, a second filtering unit inlet, comprising a separate passage from the first filtering unit outlet, located on the second side of the at least one filter, and a second filtering unit outlet located on the first side of the at least one filter, a vacuum source having a vacuum source inlet;

a separating unit;

a first air passage joining the first filtering unit outlet to the vacuum source inlet without passing through the separating unit;

a second air passage joining the second filtering unit outlet to the vacuum source inlet by way of the separating unit;

a first valve adapted to selectively open and close the first air passage;

a second valve adapted to selectively open and close the second air passage;

a third valve adapted to selectively open and close the first filtering unit inlet;

a fourth valve adapted to selectively open and close the second filtering unit inlet;

wherein:

in the vacuum cleaning mode, the first valve opens the first air passage, the second valve closes the second air passage, the third valve opens the first filtering unit inlet, and the fourth valve closes the second filtering unit inlet, and the vacuum source generates a first air flow passing through the filter from the first side of the filter to the second side of the filter, and in the filter cleaning mode, the first valve closes the first air passage, the second valve opens the second air passage, the third valve closes the first filtering unit inlet, and the fourth valve opens the second filtering unit inlet, and the vacuum source generates a second air flow passing through the filter from the second side of the filter to the first side of the filter so that dust from the filtering unit only enters the separating unit during the filter cleaning mode.

14. A vacuum cleaner according to claim 13, wherein the separating unit comprises one or more cyclone separators.

15. A vacuum cleaner according to claim 13, wherein the filtering unit comprises a plurality of filters.

16. A vacuum cleaner according to claim 13, wherein the filtering unit comprises a micro pore filter.

17. A vacuum cleaner according to claim 13, further comprising control means for controlling and activating the first valve, the second valve, the third valve, and the fourth valve.

18. A vacuum cleaner according to claim 17, wherein the control means are arranged to automatically switch the vacuum cleaner into the filter cleaning mode at the start of a vacuum cleaning procedure before entering the vacuum cleaning mode, or arranged to automatically switch the vacuum cleaner into the filter cleaning mode at the end of a vacuum cleaning procedure after leaving the vacuum cleaning mode.

* * * * *